United States Patent [19]

Child et al.

[11] 4,306,438

[45] Dec. 22, 1981

[54] METAL STRIP DOWNCOILERS-II

[75] Inventors: Roland H. Child, Oakville; Colin R. Jones, Grimsby, both of Canada

[73] Assignee: The Steel Company of Canada, Limited, Hamilton, Canada

[21] Appl. No.: 131,010

[22] Filed: Mar. 17, 1980

[30] Foreign Application Priority Data

Mar. 30, 1979 [GB] United Kingdom ..... 79111/79

[51] Int. Cl.[3] ..... B21B 47/08

[52] U.S. Cl. ..... 72/146; 242/78.1

[58] Field of Search ..... 72/146, 169; 242/78.1

[56] References Cited

U.S. PATENT DOCUMENTS

| | | | |
|---|---|---|---|
| 1,977,214 | 10/1934 | Steckel | 242/78.1 |
| 2,150,934 | 3/1939 | Millan et al. | 72/146 |
| 2,628,790 | 2/1953 | Schmidt et al. | 72/169 |
| 3,062,470 | 11/1962 | O'Brien et al. | 72/169 |
| 4,096,724 | 6/1978 | Eshelman et al. | 72/146 |

FOREIGN PATENT DOCUMENTS

| | | | |
|---|---|---|---|
| 640509 | 5/1962 | Italy | 72/146 |

*Primary Examiner*—Lowell A. Larson

*Attorney, Agent, or Firm*—Sim & McBurney

[57] ABSTRACT

There is provided an apparatus and method for selectively coiling a hot steel transfer bar or allowing the bar to pass uncoiled through the apparatus. A frame supports a number of rollers which can transfer a bar in one direction, and conventional bend roller means are located above the rollers, adapted to apply a down curvature to a transfer bar. Pivotal ramp means upstream of the bend roller means can either direct a transfer bar through the bend roller means, or allow the transfer bar to pass along the rollers under the bend roller means. A sub-frame downstream of the bend roller means carries at least one roller, and is mounted for movement between a raised position and a lowered position. In the raised position, the roller on the sub-frame defines, with a further roller upstream thereof and with a coil-guide roller located under the bend roller means, a cradle in which the initial convolutions of a coiling transfer bar can be contained. Initially, the sub-frame is in its uppermost position, to receive the initial small convolutions of a coiling transfer bar. As the transfer bar continues to coil and becomes heavier and larger in diameter, a point is reached where the sub-frame can be lowered, thus allowing a greater coil radius to be accommodated in the cradle.

10 Claims, 2 Drawing Figures

METAL STRIP DOWNCOILERS-II

Figure 1:
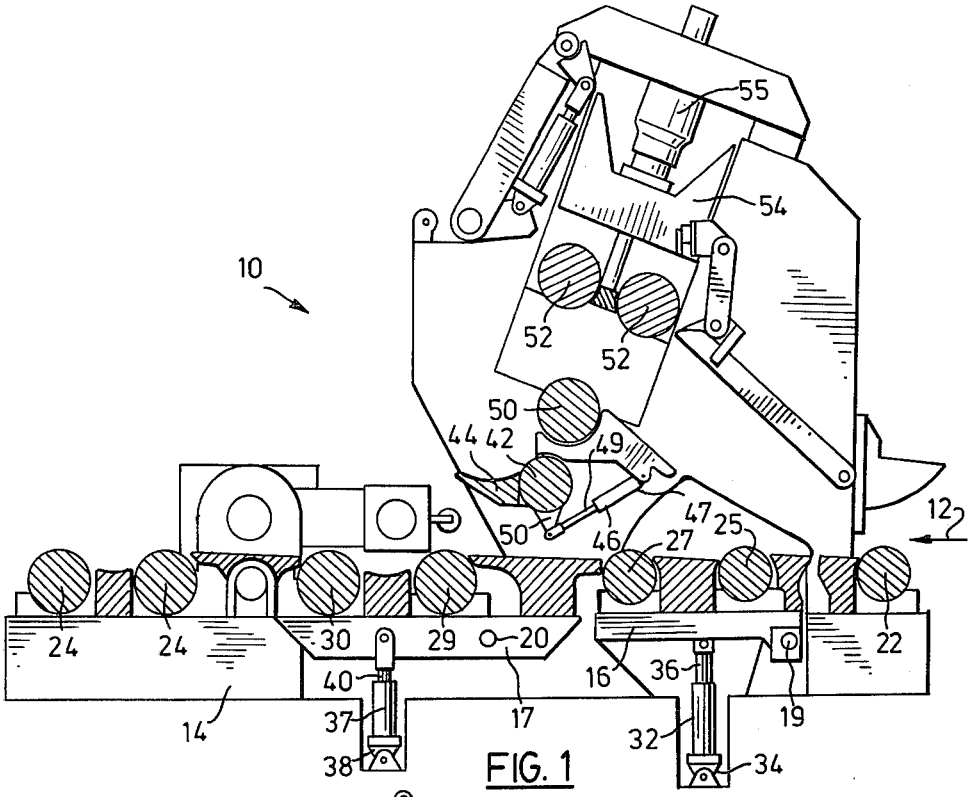

This invention relates generally to coilers for use with the rolling of hot metal workpieces, and has particularly to do with coiler apparatus not requiring a central mandrel.

The conventional method of rolling hot metal strip involves heating an ingot or slab to approximately 2300° F. (for steel) and reducing it in thickness by rolling it through a series of rolling mill stands. Normally the rolling sequence takes place in two stages referred to as roughing and finishing.

In the roughing stage, the slab or ingot normally is rolled through one or more rolling mill stands in a series of passes until it is reduced in thickness to a transfer bar approximately 1" thick. The roughing mill stage may also include one or more vertical edging mills.

Following the roughing operation, the transfer bar normally is transferred on table rolls to a continuous finishing mill train where it is further reduced to the desired gauge.

Because there are certain problems inherent in the normal method of rolling hot metal strip just described, particularly arising from the long length of time that it takes the transfer bar to feed into the finishing mill train, recent developments have been made for temporarily "storing" a hot metal strip (transfer bar) in an open-centred coil configuration between the rolling stages, for example between the roughing mill and the finishing mill.

U.S. Pat. No. 4,019,359, issued Apr. 26, 1977 to The Steel Company of Canada, Limited, and U.S. Pat. No. 4,005,830, issued Feb. 1, 1977 also the The Steel Company of Canada, Limited, relate to the construction and operation of what is called a downcoiler, capable of rolling the strip or transfer bar about itself into a coreless coil in which the heat contained in the strip is largely retained, and is not allowed to dissipate away. Numerous other advantages are inherent in the downcoiler system, and these are explained in detail in the preamble to the above-mentioned U.S. patents.

The present application relates to a further improvement in downcoilers capable of rolling a strip or transfer bar about itself in a coreless manner. In particular, the improvement disclosed herein relates to the desirability of being able to place the downcoiler portion of the mechanism "into line" or "out of line" at will, in order to have the option of either coiling a strip or transfer bar at an intermediate location between two rolling stages, or passing the strip or transfer bar directly from one stage to the other without the intermediate step of coiling the strip about itself.

Generally speaking, the apparatus adapted to accomplish the downcoiling is heavy and cumbersome, and any proposal to simply crane the apparatus or a large part of it upwardly away from the roller bed is less than practical, due to the energy and time considerations involved.

Accordingly, this application provides a means of quickly and economically placing a downcoiler apparatus "in line" or "out of line" as desired by the operator.

Thus, this invention provides apparatus for selectively (a) coiling a hot steel transfer bar or (b) allowing the bar to pass uncoiled through the apparatus, comprising:

frame means supporting a plurality of rollers for transferring a bar in one direction, bend roller means located above said plurality of rollers and being adapted to apply a down curvature to a transfer bar passing therethrough, ramp means upstream of the bend roller means with respect to said one direction and adapted selectively (a) to be placed in the path of a transfer bar to cause the latter to be deflected upwardly to enter said bend roller means, or (b) to allow the transfer bar to pass along said rollers under said bend roller means, a sub-frame downstream of the bend roller means and carrying at least one roller, the sub-frame being mounted for movement between a first position in which said at least one roller is raised above the level of the rest of the rollers, and a second position in which said at least one roller is level with the rest of the rollers, said at least one roller defining, with a further roller immediately upstream thereof and with a coil-guide roller located generally beneath the bend roller means but above said level of the rest of the rollers, a cradle in which the initial convolutions of a coiling transfer bar can be contained, the said at least one roller and the coil-guide roller defining at said further roller an angle whose value in degrees changes as said sub-frame is moved between said first and second positions.

Further, this invention provides a method of coiling a transfer bar, comprising:

(a) providing an apparatus having frame means supporting a plurality of rollers along which a transfer bar can be passed in one direction, band roller means located above said plurality of rollers, and a sub-frame downstream of the bend roller means with respect to said one direction, the sub-frame carrying at least one roller and being mounted for movement between a first position in which said at least one roller is raised above the level of the rest of the rollers, and a second position in which said at least one roller is level with the rest of the rollers, said at least one roller defining, with a further roller immediately upstream thereof and with a coil-guide roller located generally beneath the bend roller means but above said level of the rest of the rollers, a cradle in which the initial convolutions of a coiling transfer bar can be contained, moving said sub-frame to said first position, passing a transfer bar through said bend roller means, thereby curling the transfer bar, passing the transfer bar downwardly from the bend roller means to initiate coiling of the transfer bar in the said cradle, continuing the coiling of the curled transfer bar in said cradle, thereby increasing the weight applied to the rollers defining the cradle, and moving the sub-frame to said second position to allow a greater coil radius to be accommodated in said cradle.

Figure 2:
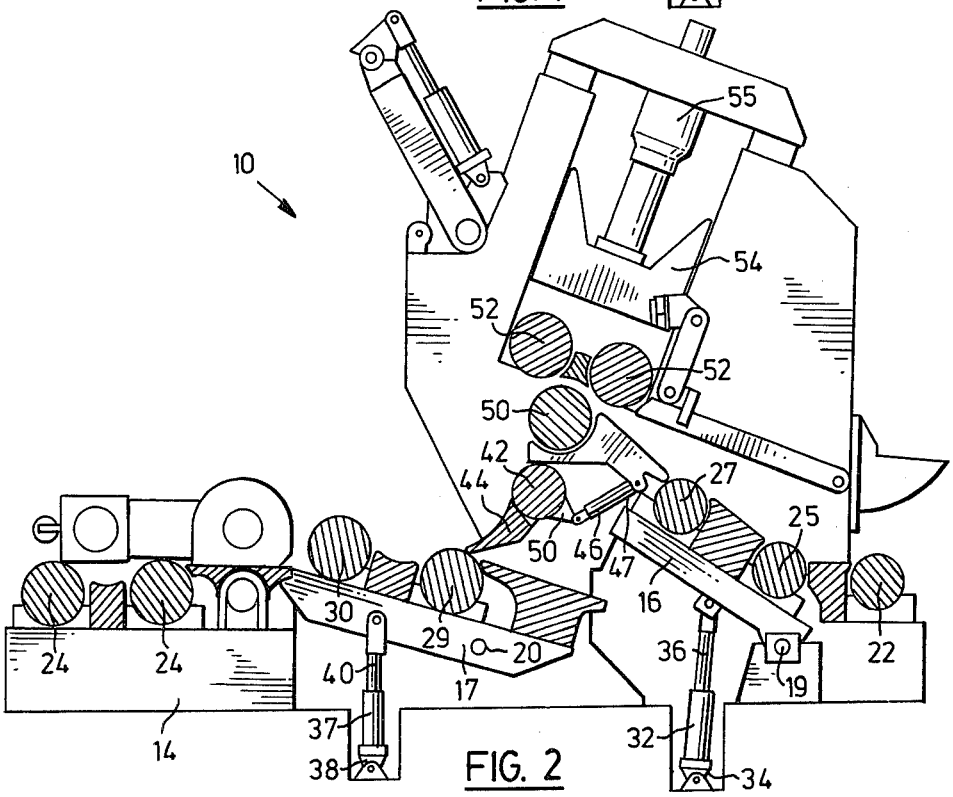

In the figures:

FIG. 1 is a vertical sectional view of a modified downcoiler apparatus, taken in the direction of movement of the transfer bar, and showing the apparatus in a first position, in which the transfer bar is allowed to pass through the apparatus without being coiled; and FIG. 2 is a view similar to FIG. 1, but showing the apparatus in a position to coil the transfer bar.

In FIG. 1, a downcoiler apparatus generally designated by the numeral 10 is adapted to receive transfer bars or steel strip moving in the direction identified by the arrow 12. At the right in FIG. 1, entry pinch rolls would normally be provided, but these have not been shown as they play no part in the present invention.

Still referring to FIG. 1, there is provided a general frame 14, and two pivotally mounted sub-frames 16 and 17. The sub-frame 16 is pivoted about the point 19, while the sub-frame 17 is pivoted about the point 20.

Mounted for rotation about an axis fixed with respect to the main frame 14 are an upstream roller 22 and two downstream rollers 24. The first sub-frame 16 carries two rollers 25 and 27, while the second sub-frame 17 carries two rollers 29 and 30.

A first hydraulic cylinder 32 is fixed at its bottom end 34 with respect to the main frame 14, and has its piston 36 connected to the first sub-frame 16 at a location displaced from the pivot point 19. A second hydraulic cylinder 37 is fixed at its bottom end 38 with respect to the main frame 14, and has its cylinder 40 attached to the second sub-frame 17 at a location spaced from the pivot point 20.

Extension of either hydraulic cylinder 32 or 37 will cause the respective sub-frame to pivot in the clockwise direction about the respective pivot point.

Located at a position above and generally between the rollers 27 and 29 is a coil-guide roller 42, about the axis of which is pivotally mounted an apron 44 controlled by a hydraulic cylinder 46. The hydraulic cylinde has its rightward upper end 47 fixed with respect to the frame, and has its piston 49 attached to an arm 50 which is rigid with respect to the apron 44. Thus, extension of the hydraulic cylinder 46 causes the apron 44 to pivot in the clockwise direction, while contraction of the hydraulic cylinder 46 causes the apron 44 to pivot in the counter-clockwise direction.

Also provided in FIG. 1 is a bottom bend roller 50, which interacts with two upper bend rollers 52. The upper bend rollers 52 are mounted on a movable carriage 54 controlled by a hydraulic piston or screw jack 55. Operation of the hydraulic piston 55 moves the upper bend rollers 52 toward and away from the lower bend roller 50. In FIG. 1 the upper bend rollers 52 are shown in retracted position, while in FIG. 2 the upper bend rollers 52 are shown in a position juxtaposed with respect to the bottom bend roller 50, such that a transfer bar passing through the bend rollers will receive a bend or curvature due to this juxtaposition.

As seen in FIG. 1, the hydraulic cylinders 32 and 37 are retracted, such that the sub-frames 16 and 17 are in their furthest counter-clockwise position, whereby the respective rollers 25, 27, 29 and 30 are in line with respect to the fixed-axis rollers 22 and 24. Also in FIG. 1, the hydraulic cylinder 46 is extended, which moves the apron 44 upwardly out of the way, so that a transfer bar travelling into the apparatus in the direction of arrow 12 will be able to pass directly through without being deflected through the nip of the bend rollers.

By extending the hydraulic cylinders 32 and 37, and simultaneously retracting the hydraulic cylinder 46, the sub-frames 16 and 17 are rotated in the clockwise direction about their respective pivot points, while the apron 44 is rotated counter-clockwise to being it down against or in close juxtaposition with the roller 29. The position of sub-frame 16 and its respective rollers 25 and 27 acts to deflect any transfer bar passing into the apparatus from the right, so that the transfer bar will be directed up between the nip of the bend rollers 50 and 52. Simultaneously, the position of the rollers 29, 30 and 42 defines a kind of "cradle" in which the initial convolutions of the coil being formed by the continuously bending transfer bar can be nested. The first convolutions are of relatively small diameter, and may or may not have a large enough radius of curvature to be able to touch all three rollers 29, 30 and 42. If not, it is contemplated that the initial convolutions will nest primarily between the rollers 29 and 42, aided to some extent by the curvature of the apron 44. As the coiling procedure continues, the radius of curvature of the outer convolution will gradually increase, to the point where the enlarging coil will touch all three rollers 29, 30 and 42. At this point, the weight of the coil will have increased substantially, and when the operator judges the time appropriate, he can contract the cylinder 37 to allow the sub-frame 17 to rotate back down in the counter-clockwise direction to its horizontal position, thus allowing for a larger radius of curvature in the coil, while still having the coil contact the rollers 29, 30 and 42.

Thus, what is provided is a method for stabilising coil set-down which incorporates a fixed forming roller 42 in conjunction with the two cradle rollers 29 and 30 which are pivotally mounted on the pivotal sub-frame 17. In effect, the axes of the rollers 29, 30 and 42 define an obtuse angle with its vertex at the axis of the roller 29, which obtuse angle can be controlled and adjusted by adjusting the extension of the hydraulic cylinder 37.

We claim:

1. Apparatus for selectively (a) coiling a hot steel transfer bar or (b) allowing the bar to pass uncoiled through the appartus, comprising:

frame means supporting a plurality of rollers for transferring a bar in one direction, bend roller means located above said plurality of rollers and being adapted to apply a down curvature to a transfer bar passing therethrough, ramp means upstream of the bend roller means with respect to said one direction and adapted selectively (a) to be placed in the path of a transfer bar to cause the latter to be deflected upwardly to enter said bend roller means, or (b) to allow the transfer bar to pass along said rollers under said bend roller means, a sub-frame downstream of the bend roller means and carrying at least one roller, the sub-frame being mounted for movement between a first position in which said at least one roller is raised above the level of the rest of the rollers, and a second position in which said at least one roller is level with the rest of the rollers, said at least one roller defining, with a further roller immediately upstream thereof and with a coil-guide roller located generally beneath the bend roller means but above said level of the rest of the rollers, a cradle in which the initial convolutions of a coiling transfer bar can be contained, the said at least one roller and the coil-guide roller defining at said further roller an angle whose value in degrees changes as said sub-frame is moved between said first and second positions.

2. The appartus claimed in claim 1, in which said angle is at all times obtuse.

3. The apparatus claimed in claim 1, in which both said at least one roller and said further roller are mounted on said sub-frame, and in which said sub-frame is pivoted at a location adjacent said further roller.

4. The apparatus claimed in claim 3, in which the sub-frame is pivoted to the said frame means, and in which hydraulic piston means is provided to move said sub-frame between said first and second positions.

5. The apparatus claimed in claim 3, in which an apron is pivoted about the axis of said coil-guide roller and is selectively controllable (a) to be lowered to span between said coil-guide roller and said further roller, or (b) to be raised away from said further roller.

6. The apparatus claimed in claim 1, claim 3 or claim 5, in which said ramp means comprises a further sub-frame having an upstream end and a downstream end, on which two of said plurality of rollers is mounted, the further sub-frame being pivotally mounted to the frame means adjacent the said upstream end, whereby the further sub-frame may be pivoted between a first position in which said two of said plurality of rollers are aligned with the general level of the other rollers of said frame means, and a second position in which the two rollers on the further sub-frame are raised above said general level and are inclined upwardly in the downstream direction adjacent said bend roller means.

7. The apparatus claimed in claim 6, including further hydraulic piston means for pivoting said further sub-frame.

8. The apparatus claimed in claim 5, in which said apron is concavely curved as seen from the location where the bar begins to coil, and in which the apron is controlled by a hydraulic piston.

9. A method of coiling a transfer bar, comprising:

(a) providing an apparatus having frame means supporting a plurality of rollers along which a transfer bar can be passed in one direction, bend roller means located above said plurality of rollers, and a sub-frame downstream of the bend roller means with respect to said one direction, the sub-frame carrying at least one roller and being mounted for movement between a first position in which said at least one roller is raised above the level of the rest of the rollers, and a second position in which said at least one roller is level with the rest of the rollers, said at least one roller defining, with a further roller immediately upstream thereof and with a coil-guide roller located generally beneath the bend roller means but above said level of the rest of the rollers, a cradle in which the initial convolutions of a coiling transfer bar can be contained, moving said sub-frame to said first position, passing a transfer bar through said bend roller means, thereby curling the transfer bar, passing the transfer bar downwardly from the bend roller means to initiate coiling of the transfer bar in the said cradle, continuing the coiling of the curled transfer bar in said cradle, thereby increasing the weight applied to the rollers defining the cradle, and moving the sub-frame to said second position to allow a greater coil radius to be accommodated in said cradle.

10. The method claimed in claim 9, in which both the said at least one roller and the further roller are mounted on said sub-frame, and in which the latter is pivoted to the frame means at a location adjacent said further roller.

* * * * *

UNITED STATES PATENT AND TRADEMARK OFFICE

CERTIFICATE OF CORRECTION

PATENT NO. : 4,306,438

DATED : December 22, 1981

INVENTOR(S) : Roland H. Child, et al

It is certified that error appears in the above—identified patent and that said Letters Patent is hereby corrected as shown below:

Column 2, line 29, "band" should read --bend--.
Column 3, lines 32, 38, 41 and 63, the numeral "50" should be changed to --51--.
In both figures 1 and 2, the bottom bend roller should be identified by the numeral --51-- instead of the numeral "50".

Signed and Sealed this

*Thirteenth* Day of *July 1982*

[SEAL]

*Attest:*

GERALD J. MOSSINGHOFF

*Attesting Officer*

*Commissioner of Patents and Trademarks*

UNITED STATES PATENT AND TRADEMARK OFFICE

CERTIFICATE OF CORRECTION

PATENT NO. : 4,306,438

DATED : December 22, 1981

INVENTOR(S) : Roland H. Child, et al

It is certified that error appears in the above—identified patent and that said Letters Patent is hereby corrected as shown below:

On the Title page item [30] Foreign Application Priority Data, the serial number of the United Kingdom priority application should read as follows:

-- 7911181 --.

Signed and Sealed this

*Seventh* Day of *September 1982*

[SEAL]

*Attest:*

GERALD J. MOSSINGHOFF

*Attesting Officer*

*Commissioner of Patents and Trademarks*